US007922503B1

(12) United States Patent
Kobayashi et al.

(10) Patent No.: US 7,922,503 B1
(45) Date of Patent: Apr. 12, 2011

(54) LEVER-TYPE CONNECTOR

(75) Inventors: Tohru Kobayashi, Makinohara (JP); Shoji Yamamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/886,681

(22) Filed: Sep. 21, 2010

(30) Foreign Application Priority Data

Sep. 24, 2009 (JP) ..... 2009-219563

(51) Int. Cl.
*H01R 13/62* (2006.01)

(52) U.S. Cl. ..... 439/157

(58) Field of Classification Search ..... 439/157, 439/158, 159
See application file for complete search history.

(56) References Cited

U.S. PATENT DOCUMENTS

| | | | | |
|---|---|---|---|---|
| 6,558,176 | B1 * | 5/2003 | Martin et al. | 439/157 |
| 7,025,610 | B2 * | 4/2006 | Demuth | 439/157 |
| 7,234,952 | B2 * | 6/2007 | Sasaki et al. | 439/157 |
| 7,267,564 | B2 * | 9/2007 | Bauman et al. | 439/157 |
| 7,559,778 | B2 * | 7/2009 | Pittenger et al. | 439/157 |
| 2005/0148221 | A1 * | 7/2005 | Miyamoto | 439/157 |
| 2006/0040535 | A1 * | 2/2006 | Koshy et al. | 439/157 |
| 2006/0281350 | A1 | 12/2006 | Yamamoto | |
| 2006/0292907 | A1 * | 12/2006 | Nishide | 439/157 |
| 2007/0032107 | A1 * | 2/2007 | Matsubara et al. | 439/157 |
| 2007/0099461 | A1 * | 5/2007 | Pittenger et al. | 439/157 |
| 2008/0248664 | A1 * | 10/2008 | Shibata | 439/157 |
| 2009/0023317 | A1 * | 1/2009 | Mizoguchi et al. | 439/157 |

FOREIGN PATENT DOCUMENTS

JP 2006-344519 A 12/2006

* cited by examiner

*Primary Examiner* — Neil Abrams
*Assistant Examiner* — Harshad C Patel
(74) *Attorney, Agent, or Firm* — Sughrue Mion, PLLC

(57) ABSTRACT

A lever-type connector includes a housing and a wire cover. Shafts are extended from the housing. A lever attached to the housing has a pair of parallel plates and a grip portion connecting the parallel plates. Each of the parallel plates is formed with a hole in which the shaft is inserted. A projection provided on the wire cover abuts one of the parallel plates in a state where the lever is attached to the housing so that the grip portion is disposed at a side of the lead-out port. A rotation preventing part is provided at one of the shafts and the hole of the one of the parallel plates and prevents a rotation of the lever in a state where the one of the parallel plates is deformed by the abutment of the projection.

5 Claims, 12 Drawing Sheets

LEVER-TYPE CONNECTOR

BACKGROUND

This invention relates to a lever-type connector.

There is known a lever-type connector in which a force for fitting connectors together is lowered (see, Patent Document 1). As shown in FIG. 12, this lever-type connector 500 comprises a housing 501, a wire cover 503 attached to the housing 501, and a lever 505 attached to the housing 501 so as to be pivotally moved between an initial position and a final position. The housing 501 has a pair of rail portions 507 formed respectively at opposite side walls thereof. A first lock recess 509*a* and a second lock recess 509*b* are formed in a side wall surface of each rail portion 507, and are spaced a predetermined distance from each other in a right-left direction as shown in FIG. 13. A pair of support shafts 511 for pivotally supporting the lever 505 are provided respectively below the rail portions 507.

When the lever 505 is attached to the housing 501 in such a manner that the lever 505 is laid down to the right side of the housing 501 in its initial position (see FIG. 12), the wire cover 503 is slid in a direction of arrow A from the right side of the housing 501 toward the left side, with its wire lead-out port 513 disposed at the front. Namely, the lever 505 is earlier attached to the housing 501 than the wire cover 503. At this time, sliding claws 515 (see FIG. 14) of the wire cover 503 are fitted respectively into the rail portions 507 of the housing 501, and then the wire cover 503 is slid from the right side toward the left side. Then, lock projections 517 (see FIG. 14) formed respectively at the sliding claws 515 are fitted respectively into the first lock recesses 509*a* formed at the housing 501, so that the wire cover 503 is locked to the housing 501.

The lever 505 can be attached to the housing 501 in such a manner that the lever 505 is laid down to either of the right side and left side of the housing 501 in its initial position. When the lever 505 is attached to the housing 501 in such a manner that the lever 505 is laid down to the right side of the housing 501 in its initial position, the wire cover 503 can be slid from the right side of the housing 501 toward the left side, with the wire lead-out port 513 disposed at the front, and can be locked to the housing 501. On the other hand, when the lever 505 is attached to the housing 501 in such a manner that the lever 505 is laid down to the left side of the housing 501 in its initial position, the wire cover 503 can be slid from the left side of the housing 501 toward the right side, with the wire lead-out port 513 disposed at the front, and can be locked to the housing 501.

Here, when the lever 505 is attached to the housing 501 in such a manner that the lever 505 is laid down to the right side of the housing 501 as shown in FIG. 12, there is a possibility that the wire cover 503 may be attached in a wrong manner, that is, the wire cover 503 may be slid in a direction of arrow E from the left side of the housing 501 to the right side, with the wire lead-out port 513 disposed at the front as shown in FIG. 15. In this case, when the lock projections 517 (see FIG. 14) formed respectively at the sliding claws 515 are fitted respectively into the second lock recesses 509*b* (see FIG. 13) to thereby lock the wire cover 503 to the housing 501, there is encountered a problem that the direction of attaching of the wire cover 503 is reverse to the intended direction, and therefore the direction of leading-out of wires is reverse to the intended direction.

To avoid this problem, the lever-type connector 500 is provided with lock prevention means 519. The lock prevention means 519 includes a pair of first projections 523 formed respectively at a pair of leg portions 521 of the lever 505, and a pair of second projections 525 formed at the wire cover 503 so as to abut respectively against the pair of first projections 523.

For example, when the wire cover 503 is slid from the left side of the housing 501 toward the right side, with the wire lead-out port 513 disposed at the front as shown in FIG. 15, the second projections 525 are brought into abutting engagement with the respective first projections 523, thereby preventing the lock projections 517 (formed respectively on the sliding claws 515) from fitting into the respective second lock recesses 509*b*, thus preventing the locking of the wire cover 503 relative to the housing 501.

In the lever-type connector 500, the lock prevention means 519 is thus provided at the lever 505 and the wire cover 503, and with this construction, when the wire cover 503 is wrongly attached to the housing 501 in the reverse direction, the lock projections 517 are prevented from fitting into the respective second lock recesses 509*b*, or the lock projections 517 are prevented from fitting into the respective first lock recesses 509*a*, and by doing so, the wire cover 503 is prevented from being locked to the housing 501 in the wrongly-attached condition.

In the above conventional lever-type connector 500, however, when the wire cover 503 is earlier attached to the housing 501 than the lever 505, the lever 505 can be pivotally moved even in the wrongly-attached condition. In addition, when the wire cover 503 disposed in the reverse direction is strongly slid in the attaching direction (the direction E), the pair of leg portions 521 and 521 of the lever 505 are opened or moved away from each other, and the first projections 523 slide respectively onto the second projections 525, so that the wire cover 503 can be slid, and in this case, also, the lever 505 can be pivotally moved in the wrongly-attached condition.

[Patent Document 1] Japanese Patent Publication Number 2006-344519

SUMMARY

It is therefore one advantageous aspect of the present invention to provide a lever-type connector in which a lever can be positively prevented from being pivotally moved in a wrongly-attached condition.

The above object of the present invention has been achieved by the following construction.

According to one aspect of the invention, there is provided a lever-type connector, including:

a housing formed with an opening in front face thereof in a first direction in which a mating connector is fitted, and having a rear face from which a wire is led out in a second direction orthogonal to the first direction;

a wire cover attached to the housing and having a lead-out port of the wire opening in the second direction;

a pair of shafts extended from both sides of the housing in a third direction orthogonal to both of the first direction and the second direction;

a lever attached to the housing and having a pair of parallel plates and a grip portion connecting the parallel plates, each of the parallel plates formed with a hole in which the shaft is inserted;

a projection provided on the wire cover and configured to abut one of the parallel plates in a state where the lever is attached to the housing so that the grip portion is disposed at a side of the lead-out port; and a rotation preventing part provided at one of the shafts and the hole of the one of the parallel plates and configured to prevent a rotation of the lever in a state where the one of the parallel plates is deformed by the abutment of the projection.

The rotation preventing part may include: a key projected from the shaft in a radius direction of the shaft; a key groove formed on an inside face opposing the housing so as to cutout an inner face of the hole in the radius direction; and a recess formed on an outside face opposite to the inner face with the hole and configured to allow the rotation of the one of the parallel plates with respect to the key.

The rotation preventing part may be provided at the pair of shafts and the holes of the pair of the parallel plates.

The wire cover may be configured to be attached to the housing so that the lead-out port opens in one of frontward of the second direction and rearward of the second direction.

DETAILED DESCRIPTION OF EXEMPLIFIED EMBODIMENTS

A preferred embodiment of the present invention will now be described with reference to the drawings.

Figure 1:
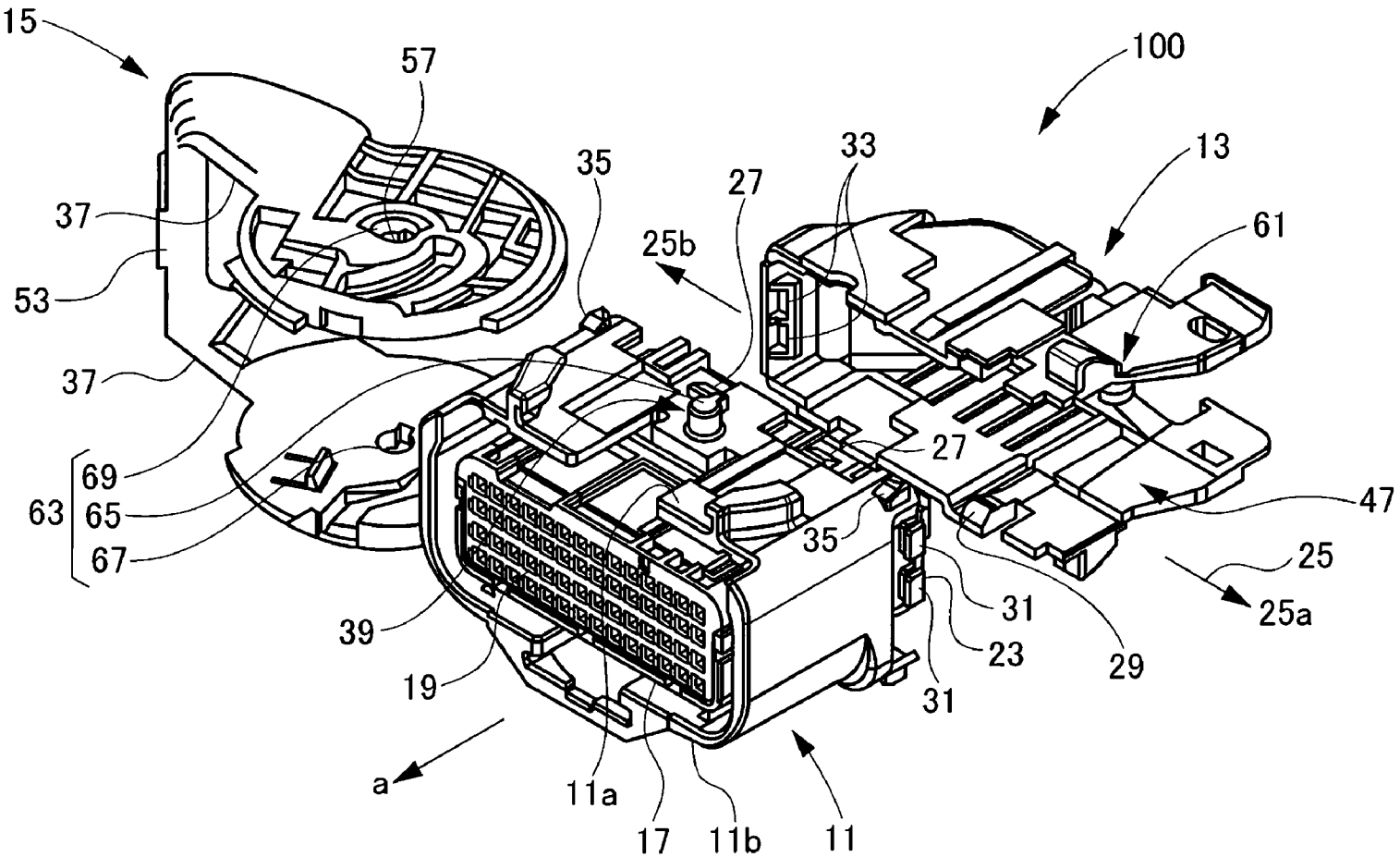
FIG. 1 is an exploded perspective view of a lever-type connector of the present invention.

FIG. 1 is an exploded perspective view of a lever-type connector of the present invention.

The lever-type connector 100 comprises a connector housing 11, a wire cover 13, and a lever 15. Each of the connector housing 11, the wire cover 13 and the lever 11 is molded into a one-piece construction, using a resin (such for example as polybutylene terephthalate). In the present specification, the fitting side of the connector housing 11 is defined as the front side, and the opposite side is defined as the rear side. The connector housing 11 has a generally rectangular parallelepiped shape, and a fitting opening portion 17 is formed at a front side of this connector housing 11 facing in the fitting direction indicated as arrow a in the drawing. In the lever-type connector 100, by pivotally moving the lever 15 serving to lower a fitting force, a mating connector (not shown) is drawn into the fitting opening portion 17 to be fitted thereinto. Therefore, the fitting direction a shows the direction of fitting of the connector housing 11 relative to the mating connector.

A plurality of terminal entry ports 19 are provided in the fitting opening portion 17, and are arranged in columns and rows. The terminal entry ports 19 communicate respectively with terminal receiving chambers (not shown) formed within the connector housing 11, and metal terminals (not shown) are received in the terminal receiving chambers, respectively. Wires 21 (see FIG. 9) are connected to rear ends of the metal terminals, respectively, and the wires 21 are led out from a rear side 23 of the connector housing 11. According to a predetermined specification of a vehicle on which the connector is to be mounted, the wires 21 led out from the rear side 23 are bent to extend in one of two opposite directions 25*a* and 25*b* along a straight line 25 perpendicular to the fitting direction a.

Figure 2:
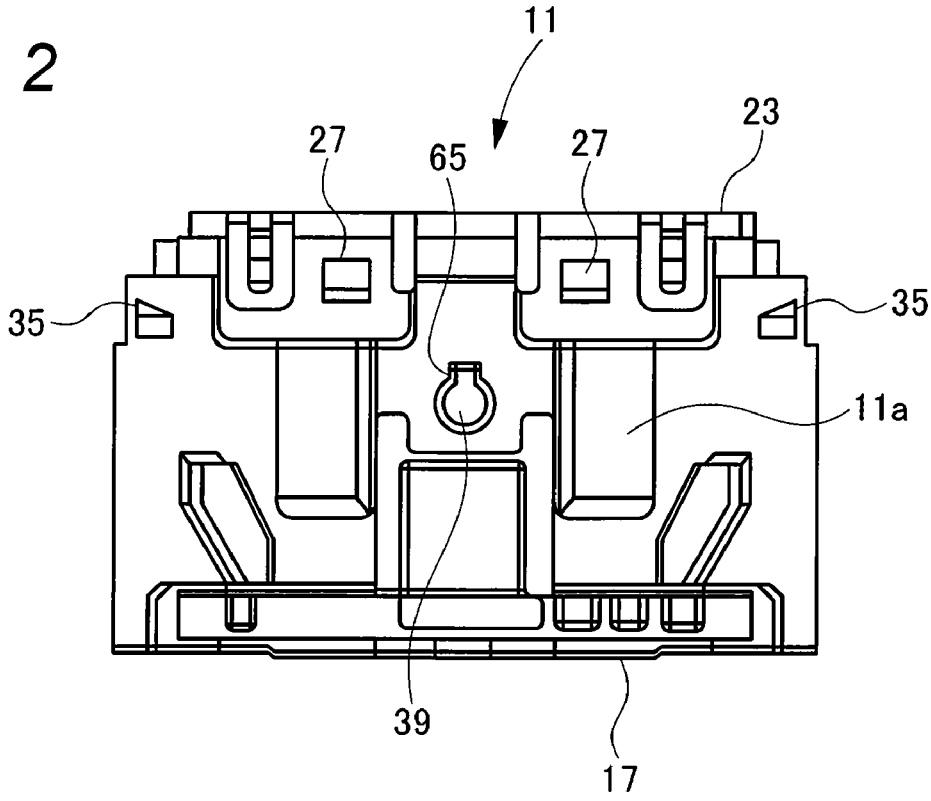
FIG. 2 is a side-elevational view of a connector housing shown in FIG. 1.

FIG. 2 is a side-elevational view of the connector housing shown in FIG. 1.

As shown in FIGS. 1 and 2, two pairs of wire cover retaining portions 27 of a slanting projection-shape for retaining the wire cover 13 are formed on the connector housing 11, and each pair of wire cover retaining portions 27 and 27 are formed respectively on opposite side portions 11*a* and 11*b* (see FIG. 1) of the connector housing 11. The pair of wire cover retaining portion 27 are retained respectively on retaining projections 29 (described later) of a slanting projection-shape formed on the wire cover 13. The wire cover 13 is attached to the connector housing 11 to cover the rear side 23 thereof, with the retaining projections 29 retained respectively on the pair of wire cover retaining portions 27. As shown in FIG. 2, the wire cover retaining portions 27 and 27 on each of the opposite side portions 11*a* and 11*b* of the connector housing 11 are arranged bilaterally symmetrically.

A pair of retaining claws 31 and 31 (see FIG. 1) are formed on and project from each of the other opposite side faces of the connector housing 11. When attaching the wire cover 13 to the connector housing 11, the pair of retaining claws 31 and 31 are retained respectively on a pair of retaining portions 33 and 33 of the wire cover 13. A pair of provisionally-retaining projections 35 and 35 are formed respectively at left end portions of the opposite side portions 11*a* and 11*b* of the connector housing 11, and another pair of provisionally-retaining projections 35 and 35 are formed respectively at right end portions of the opposite side portions 11*a* and 11*b* of the connector housing 11. The pair of provisionally-retaining projections 35 and 35 are engaged respectively with lever provisionally-retaining portions 37 and 37 of the lever 15. When the lever provisionally-retaining portions 37 and 37 are engaged respectively with the provisionally-retaining projections 35 and 35, the lever 15 is retained in a provisionally-retained position shown in FIG. 9.

A pair of shafts 39 and 39 are formed respectively on the opposite side portions 11*a* and 11*b* of the connector housing 11, and project perpendicularly to the direction of arrow a and also to the direction of the straight line 25. Rotation prevention means (described later) is provided at a distal end of each of the shafts 39.

Figure 3:
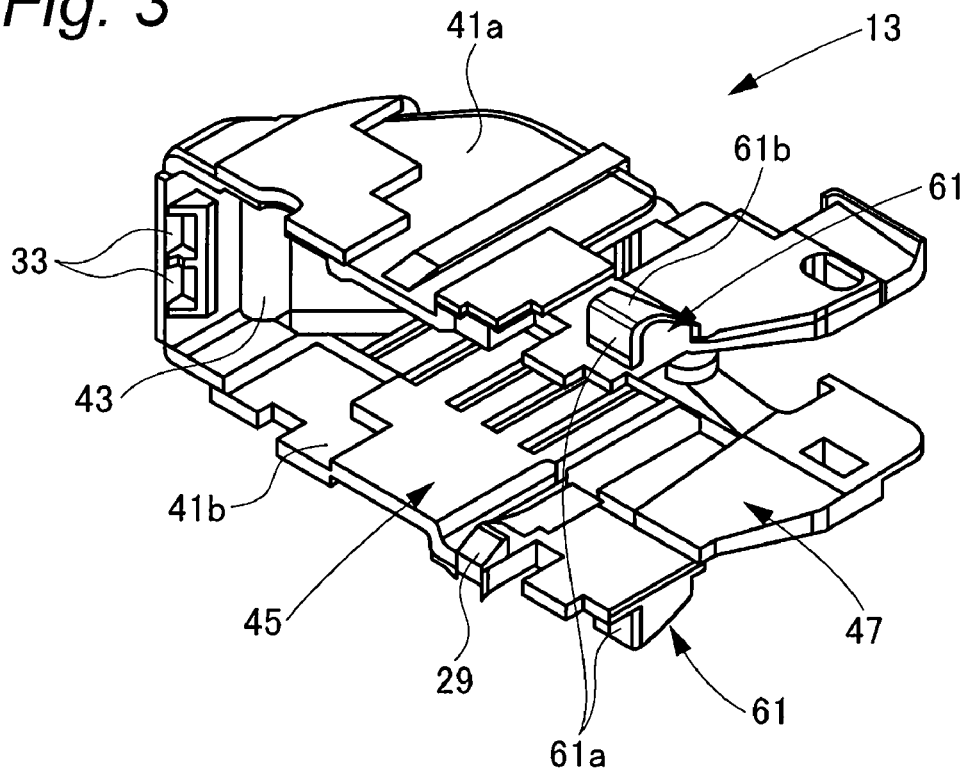
FIG. 3 is a perspective view of a wire cover shown in FIG. 1.

FIG. 3 is a perspective view of the wire cover shown in FIG. 3.

The wire cover 13 has a pair of parallel side plates 41*a* and 41*b* interconnected at their one ends by a slanting wall plate 43, and is formed into a box-like shape open in two directions. One opening of the wire cover 13 serves as a wire introduction opening 45 for covering the rear side 23 of the connector housing 11, and the other opening serves as a wire lead-out opening 47 for the leading-out of the wires 21 therethrough. The above-mentioned retaining projections 29 are formed respectively at lower end portions of inner surfaces of the side plates 41*a* and 41*b* which are disposed near to the wire lead-out opening 47. The above-mentioned retaining portions 33 and 33 are formed at a lower end portion of an inner surface of the slanting wall plate 43.

The wire cover retaining portions 27 and 27 (see FIG. 2) formed on each of the opposite side portions 11*a* and 11*b* of the connector housing 11 are arranged bilaterally symmetrically as described above, and the retaining projection 29 formed on each of the side plates 41*a* and 41*b* of the wire cover 13 can be engaged with either of the bilaterally symmetrically-arranged wire cover retaining portions 27 and 27. Therefore, the wire cover 13 can be selectively attached to the connector housing 11 in such a manner that the wire lead-out opening 47 is directed in one of the two opposite directions, that is, in one direction 25*a* or the other direction 25*b* along the straight line 25 shown in FIG. 1.

Figure 4:
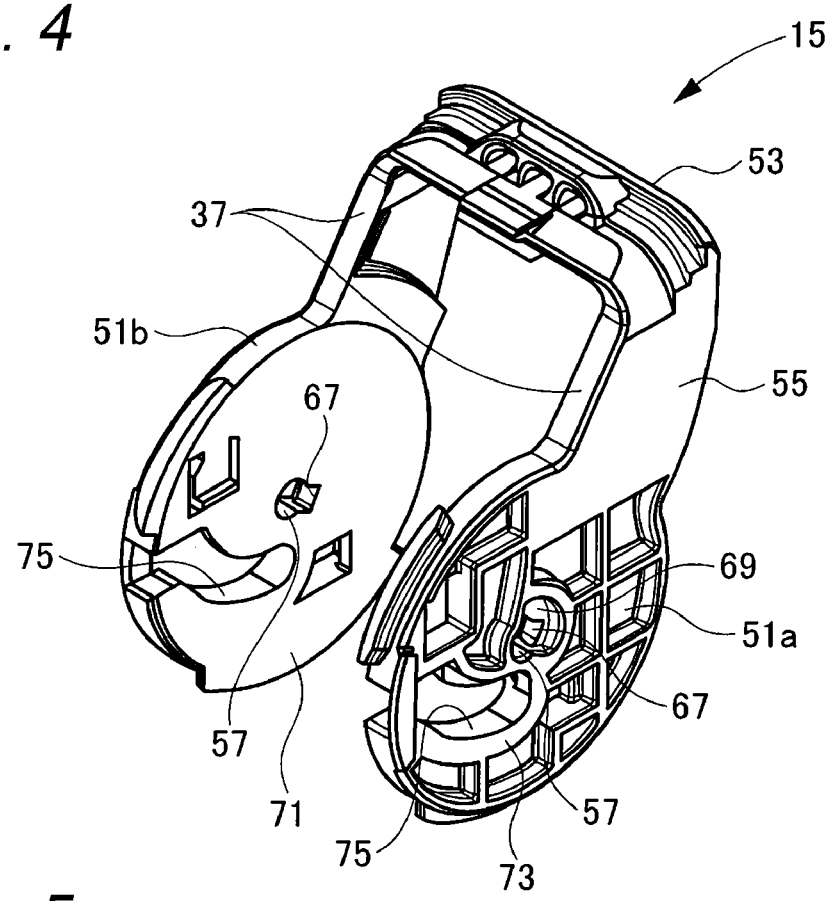
FIG. 4 is a perspective view of a lever shown in FIG. 1.

FIG. 4 is a perspective view of the lever shown in FIG. 1.

The lever 15 includes a pair of parallel plates 51*a* and 51*b* of a generally disk-shape, and a grip portion 53 interconnecting one ends of the parallel plates 51*a* and 51*b*. That portion of the lever 15 lying between each parallel plate 51*a*, 51*b* and the grip portion 53 serves as an arm portion 55. The lever provisionally-retaining portion 37 is formed at one side edge portion of each arm portion 55.

Figure 5:
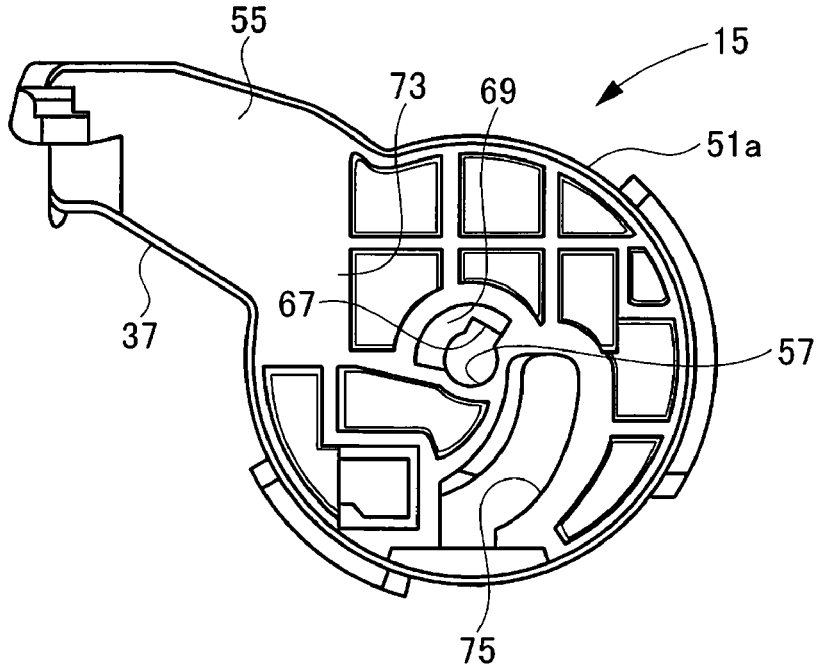
FIG. 5 is a side-elevational view of the lever as seen from an outer side of a parallel plate.

FIG. 5 is a side-elevational view of the lever as seen form an outer side of the parallel plate.

Reception holes 57 and 57 each for the fitting of the corresponding shaft 39 of the connector housing 11 thereinto are formed respectively in the parallel plates 51*a* and 51*b*. The lever 11 can be selectively attached to the connector housing 11 in such a manner that the lever 15 can be operated to be pivotally moved about the shafts 39 (see FIG. 2) in one of two directions, that is, a clockwise direction and a counterclockwise direction.

As described above, the wire cover 13 can be selectively attached to the connector housing 11 in such a manner that the wire lead-out opening 47 for the leading-out of the wires 21 therethrough is directed in one of the two opposite directions, that is, in the one direction 25*a* or the other direction 25*b* along the straight line 25 (see FIG. 1). Also, the lever 15 can be selectively attached to the connector housing 11 in such a manner that the grip portion 53 is directed in one of the two opposite directions, that is, in the one direction 25*a* or the other direction 25*b* (see FIG. 1). However, the wire cover 13 and the lever 15 are attached to the connector housing 11 in such a manner that the grip portion 53 of the lever 13 is not located at that side where the wire lead-out portion 47 of the wire cover 13 is disposed. If the grip portion 53 is located at the side where the wire lead-out portion 47 is disposed, this is wrong attachment as shown as a lever wrongly-attached condition in FIG. 10).

In order to prevent this wrong attachment, the lever-type connector 100 is provided with detection projections 61 and the rotation prevention means 63 (see FIG. 1). The detection projections 61 are formed on the parallel side plates 41*a* and 41*b* of the wire cover 13, respectively. As shown in FIG. 3, the detection projection 61 includes a vertical portion 61*a* facing in the forward direction of the connector housing 11, and a rear slanting portion 61*b*, and projects from the side plate 41*a*, 41*b*. The detection projections 61 abut respectively against the parallel plates 51*a* and 51*b* of the lever 15 wrongly attached in a reverse direction relative to the direction of attaching of the wire cover 13. On the other hand, when the lever 15 is earlier attached to the connector housing 11 than the wire cover 13, and the wire cover 13 is then wrongly attached in a reverse direction relative to the direction of attaching of the earlier-attached lever 15, the detection projections 61 abut respectively against the arm portions 55 of the lever 15.

When the lever 15 abuts against the detection projections 61 at the time of attaching the lever 15, the detection projections 61 detect the wrong attachment of the lever 15 from this. The lever-type connector 100 is provided with the rotation prevention means 63 for preventing the rotation (or pivotal movement) of the lever 15 even when the wrongly-attached lever 15 is pivotally moved without noticing this detection. Each rotation prevention means 63 is provided at the shaft 39 and the reception hole 57, and the rotation prevention means 63 prevent the pivotal movement of the lever 15 by displacement of the parallel plates 51*a* and 51*b* sliding onto the respective detection projections 61.

Each rotation prevention means 63 includes a key 65, a key groove 67, and a key receiving recess 69. The key 65 is a polygonal convex portion formed at and projecting radially outwardly from the distal end of the shaft 39. The shaft 39 has a proximal end portion which has a round cross-section or may have any other suitable cross-section not projecting from a round outer diameter.

The key groove 67 is formed in an inner surface 71 (see FIG. 4) of the parallel plate 51*a*, 51*b*, and is a notch groove formed by notching an inner peripheral surface of the reception hole 57 in a radially outward direction, and the key 65 is fitted in the key groove 67. This key groove 67 extends through the parallel plate 51*a*, 51*b* from the inner surface 71 thereof to an outer surface 73 thereof.

The key receiving recess 69 is formed, together with the reception hole 57, in the outer surface 73 of the parallel plate 51*a*, 51*b*. As shown in FIG. 5, the key receiving recess 69 is the generally sector-shaped recess which allows the rotation of the parallel plate 51*a*, 51*b* relative to the key 65. The reception hole 57 and the key groove 67 are open to a bottom surface of the key receiving recess 69 of the sector-shape.

For attaching the lever 16 on the shafts 39, the parallel plates 51*a* and 51*b* are elastically opened or moved away from each other, and the shafts 39 are inserted respectively into the reception holes 57 at the inner surfaces 71. At this time, the key 65 formed at the distal end of the shaft 39 is fitted into the key groove 67 notched in the inner peripheral surface of the reception hole 57, and by doing so, the shaft 39 can be inserted into the reception hole 57. The key 65 and the shaft 39 inserted respectively in the key groove 67 and the reception hole 57 project into the key receiving recess 69 at the outer surface (73) side of the parallel plate 51*a*, 51*b*.

In properly-attached conditions (shown in FIG. 9) of the wire cover 13 and the lever 15, when the lever 15 is rotated or pivotally moved, each key groove 67 moves in the rotating direction relative to the key 65. At this time, each parallel plate 51*a*, 51*b* rotates, with the bottom surface of the key receiving recess 69 held in sliding contact with the key 65. The key groove 67 is moved away from the key 65 in the rotating direction. At this time, the keys 65 are held in sliding contact with the bottom surfaces of the key receiving recesses 69, respectively, thereby preventing the parallel plates 51*a* and 51*b* from lifting off the opposite side portions 11*a* and 11*b* of the connector housing 11, respectively.

In the lever-type connector 100, the mating connector (not shown) is fitted to the fitting opening portion 17, and at this time guide pins formed at the mating connector are fitted respectively into guide holes 75 of the lever 15. The guide pins are pulled upwardly in accordance with the pivotal movement of the lever 15, and the mating connector is fitted to the fitting opening portion 17 of the connector housing 11.

Next, the operation of the lever-type connector having the above construction will be described.

Figure 6B:
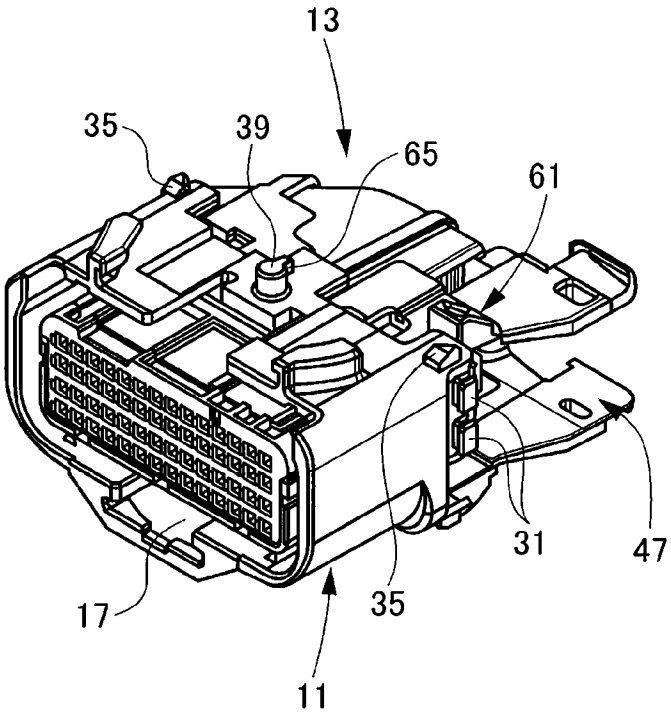
FIG. 6B is a perspective view showing a condition in which the connector housing and the wire cover are assembled together.
Figure 6A:
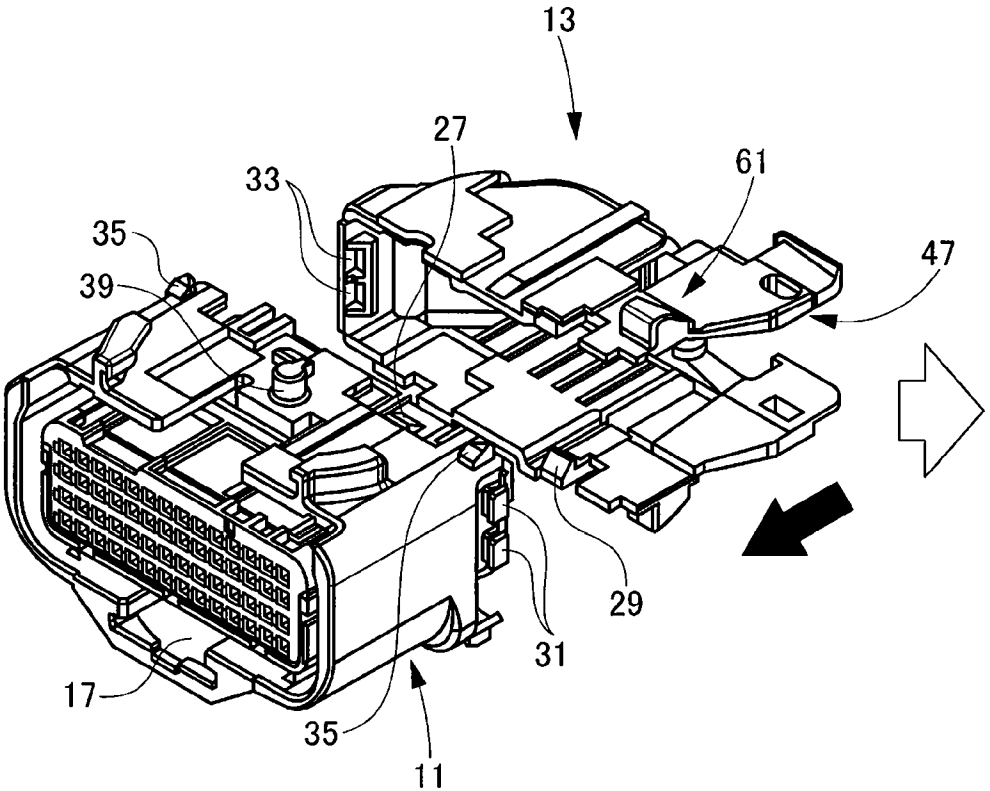
FIG. 6A is an exploded perspective view showing the connector housing and the wire cover.

FIG. 6A is an exploded perspective view showing the connector housing and the wire cover, and FIG. 6B is a perspective view showing a condition in which the connector housing and the wire cover are assembled together.

Here, description will be made of the case where the wire cover 13 is earlier attached to the connector housing 11 than the lever 15.

For assembling the lever-type connector 100, first, the wire cover 13 is attached to the connector housing 11. More specifically, the wire cover 13 is fitted on the rear side 23 of the connector housing 11, and the retaining projections 29 (see FIG. 6A) are retained respectively on the wire cover retaining portions 27, thus completing this attaching operation as shown in FIG. 6B. The wire lead-out opening 47 for the leading-out of the wires 21 therethrough is open to the right side in FIG. 6B.

Figure 7:
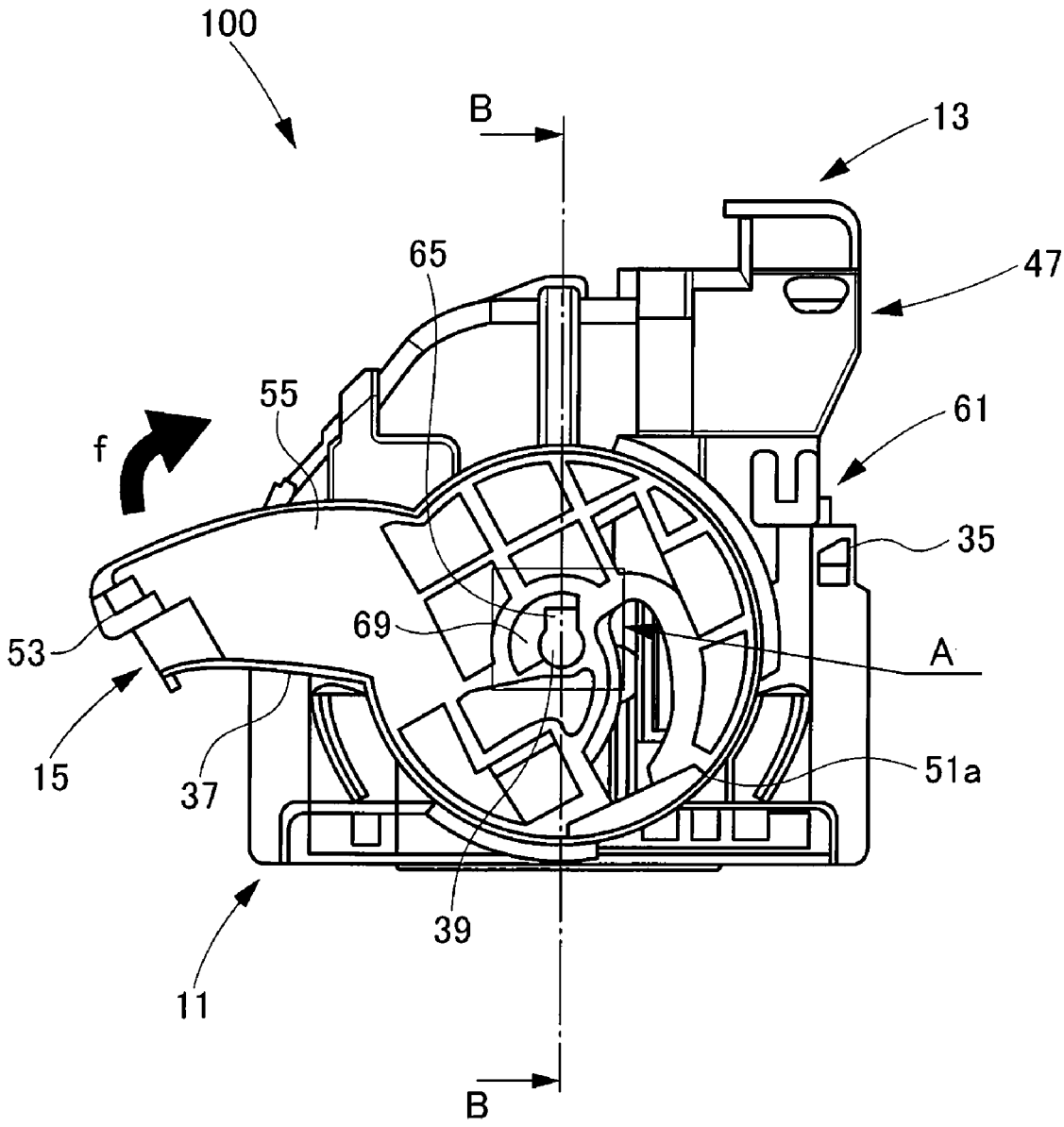
FIG. 7 is a side-elevational view showing a lever-attached condition.
Figure 8C:
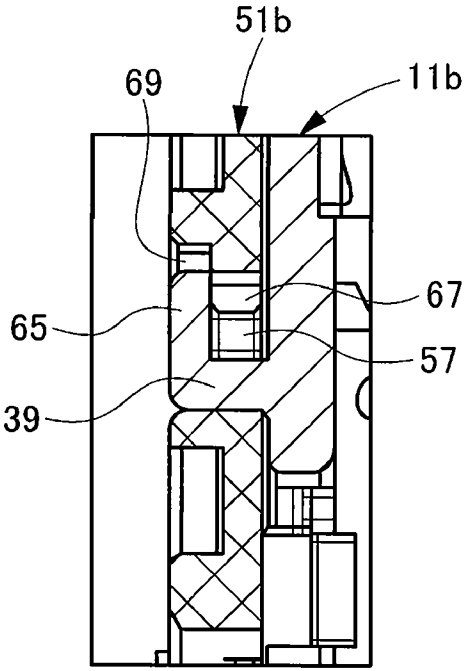
FIG. 8C is an enlarged view of a portion C of FIG. 8B.
Figure 8B:
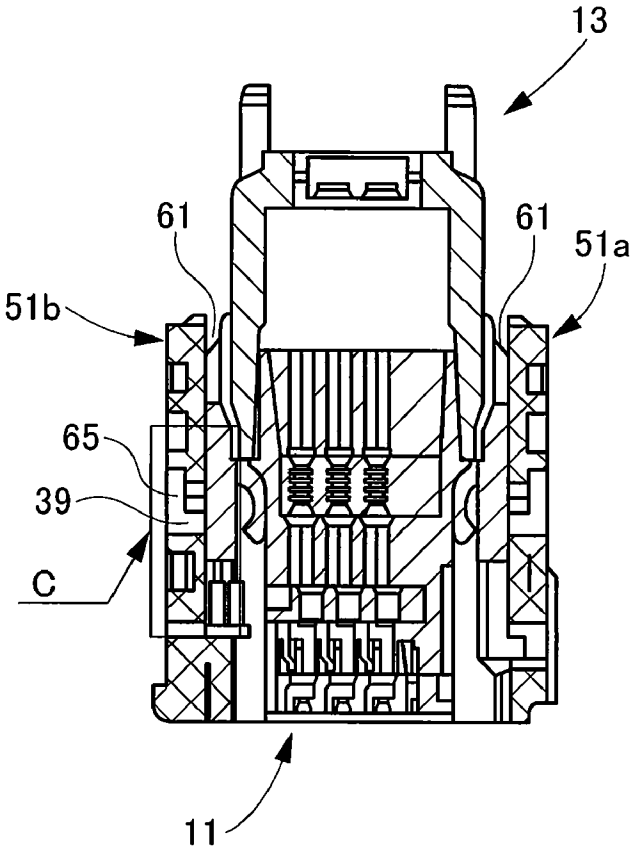
FIG. 8B is a cross-sectional view taken along the line B-B of FIG. 7.
Figure 8A:
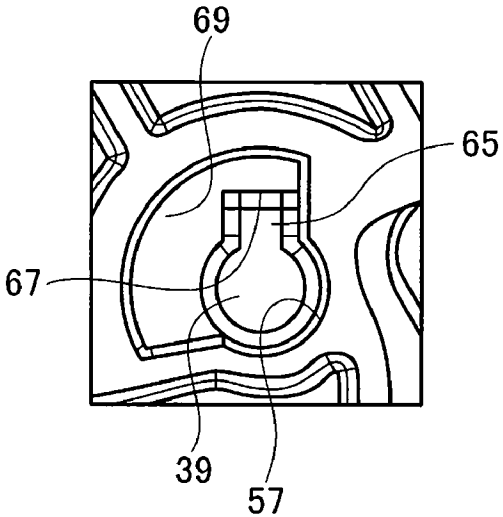
FIG. 8A is an enlarged view of a portion A of FIG. 7.

FIG. 7 is a side-elevational view showing the lever-attached condition, FIG. 8A is an enlarged view of a portion A of FIG. 7, FIG. 8B is a cross-sectional view taken along the line B-B of FIG. 7, and FIG. 8C is an enlarged view of a portion C of FIG. 8B.

Then, the lever 15 is attached to the connector housing 11 having the wire cover 13 attached thereto.

When the lever 15 is attached in the proper direction, the grip portion 53 is disposed at that side opposite from the wire lead-out opening 47 as shown in FIG. 7. The lever 15 is attached to the connector housing 11 in such a manner that the shafts 39 are inserted respectively into the reception holes 57, with the pair of parallel plates 51*a* and 51*b* disposed in contiguous relation respectively to the opposite side portions 11*a* and 11*b* of the connector housing 11, as shown in FIG. 8B. At this time, each shaft 39 is inserted into the reception hole 57 in such a manner that the direction of the key 65 of the shaft 39 coincides with the direction of the key groove 67 as shown in FIG. 8A.

When the lever 15 is attached to the connector housing 11 in the proper direction, each key 65 projects into the key receiving recess 69 and is disposed therein as shown in FIG. 8C. Then, the lever 15 is pivotally moved in a direction of arrow f (FIG. 7), and the lever provisionally-retaining portions 37 are retained respectively on the provisionally-retaining projections 35 concealed respectively at the back sides of the arm portions 55, thereby retaining the lever 15 in the provisionally-retained position. As will be appreciated from FIG. 8A, the key receiving recess 69 has a rotation allowing space (for the key 65) disposed at that side opposite from the rotating direction, and therefore the lever 15 can be pivotally moved in the direction directed as arrow f in the drawing.

Figure 9B:
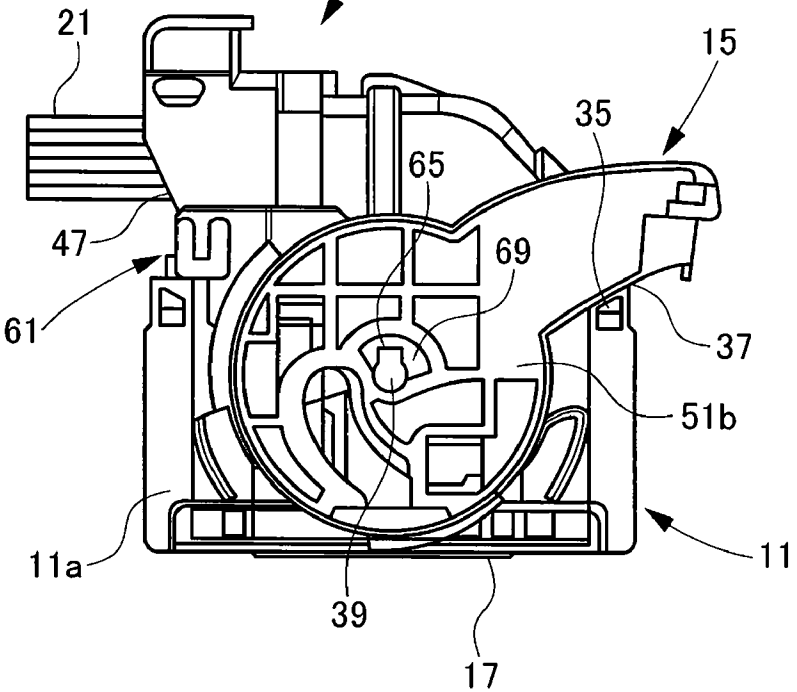
FIG. 9B is a side-elevational view of the lever-type connector in which the lever is properly attached to be directed in the right direction.
Figure 9A:
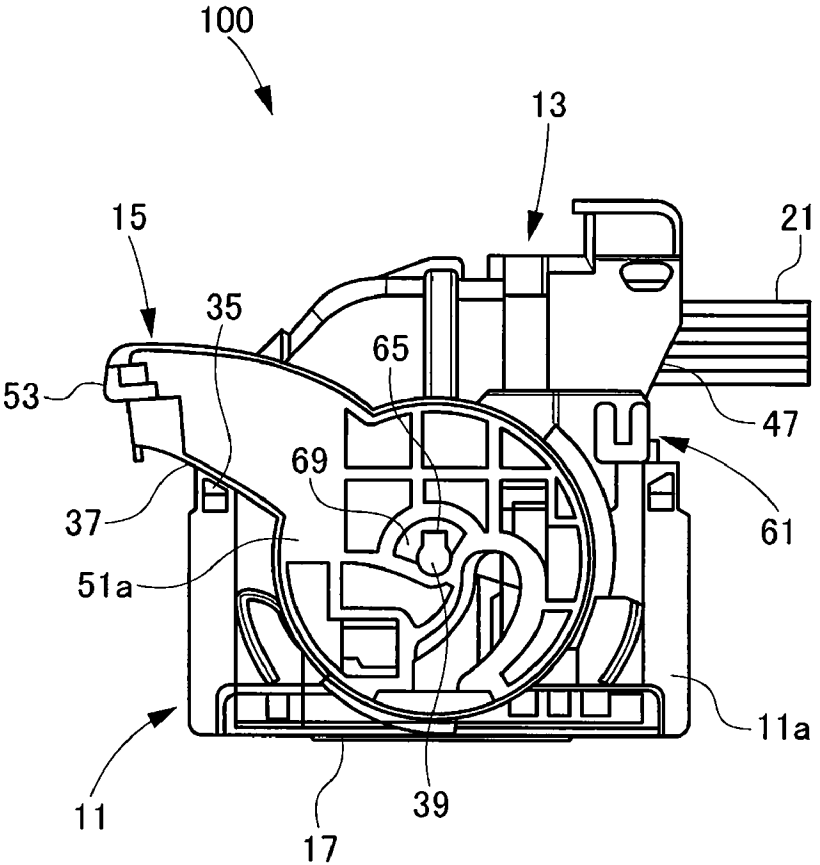
FIG. 9A is a side-elevational view of the lever-type connector in which the lever is properly attached to be directed in the left direction.

FIG. 9A is a side-elevational view of the lever-type connector in which the lever is properly attached to be directed in the left direction, and FIG. 9B is a side-elevational view of the lever-type connector in which the lever is properly attached to be directed in the right direction.

When the wire cover 13 is properly attached to the connector housing 11, with the wire lead-out opening 47 directed in the right direction as in this embodiment, the grip portion 53 of the properly-attached lever 15 is disposed at the left side opposite from the wire lead-out opening 47 as shown in FIG. 9A. In contrast, when the wire cover 13 is properly attached to the connector housing 11, with the wire lead-out opening 47 directed in the left direction, the grip portion 53 of the properly-attached lever 15 is disposed at the right side opposite from the wire lead-out opening 47 as shown in FIG. 9B.

Figure 10:
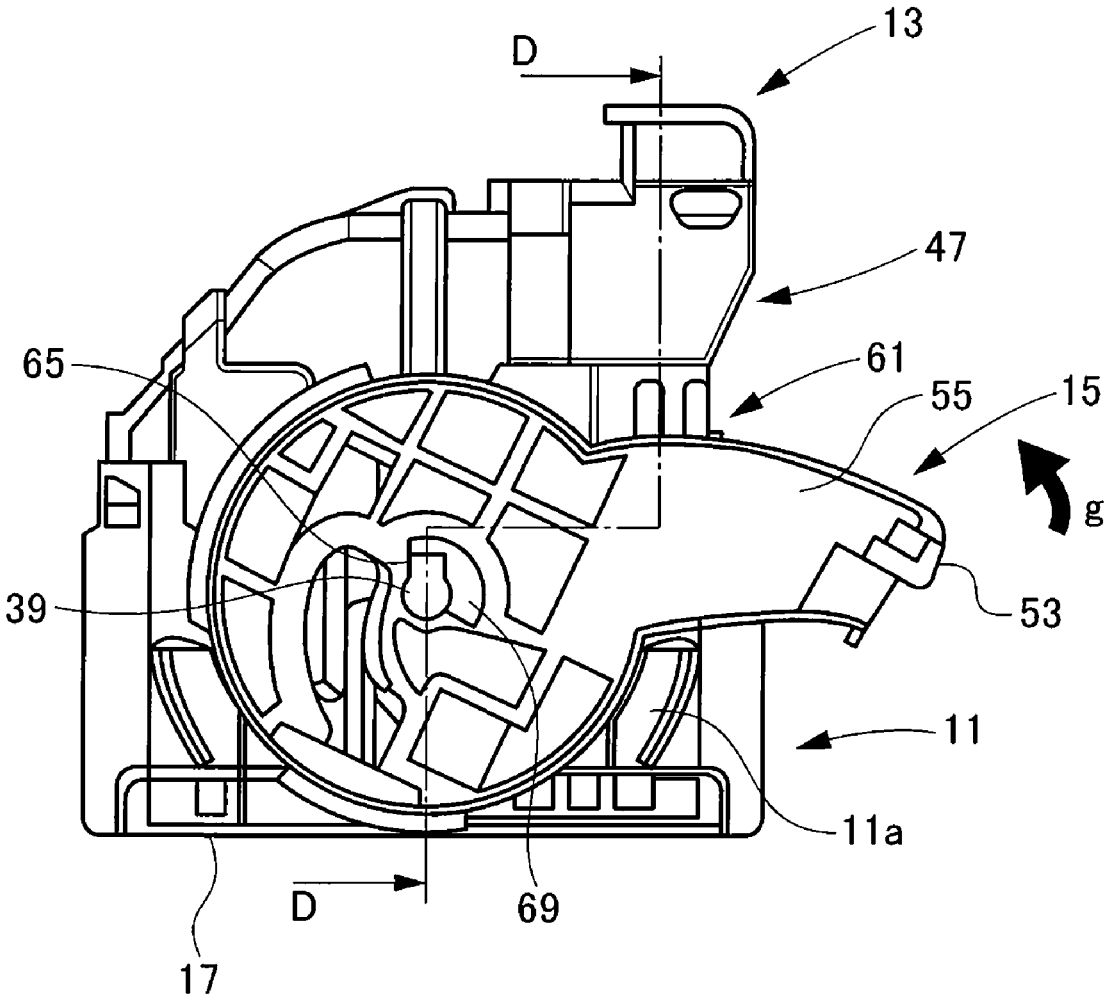
FIG. 10 is a side-elevational view of the lever-type connector in which the lever is reversely attached.

FIG. 10 is a side-elevational view of the lever-type connector in which the lever is reversely attached.

When the lever 15 is wrongly attached in the reverse direction, the grip portion 53 is disposed at the same side as the wire lead-out opening 47. Even in the case of the wrong attachment, each shaft 39 is inserted into the reception hole 57 in such a manner that the direction of the key 65 of the shaft 39 coincides with the direction of the key groove 67. At this time, the lever 15 is attached to the connector housing 11 from the rear side in such a manner that the parallel plates 51*a* and 51*b* are elastically deformed away from each other and then hold the wire cover 13 therebetween. As a result of this wrong attachment, the parallel plates 51*a* and 51*b*, more accurately the arm portions 55, of the lever 15 abut respectively against the slanting portions 61*b* (see FIG. 3) of the detection projections 61 and slide respectively onto these slanting portions 61*b*.

Figure 11B:
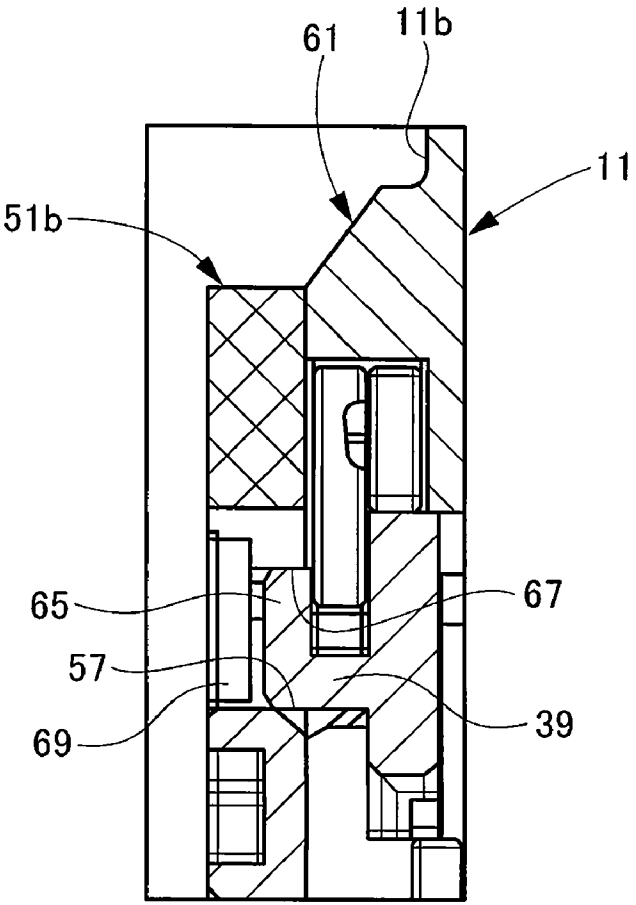
FIG. 11B is an enlarged view of a portion E of FIG. 11A.
Figure 11A:
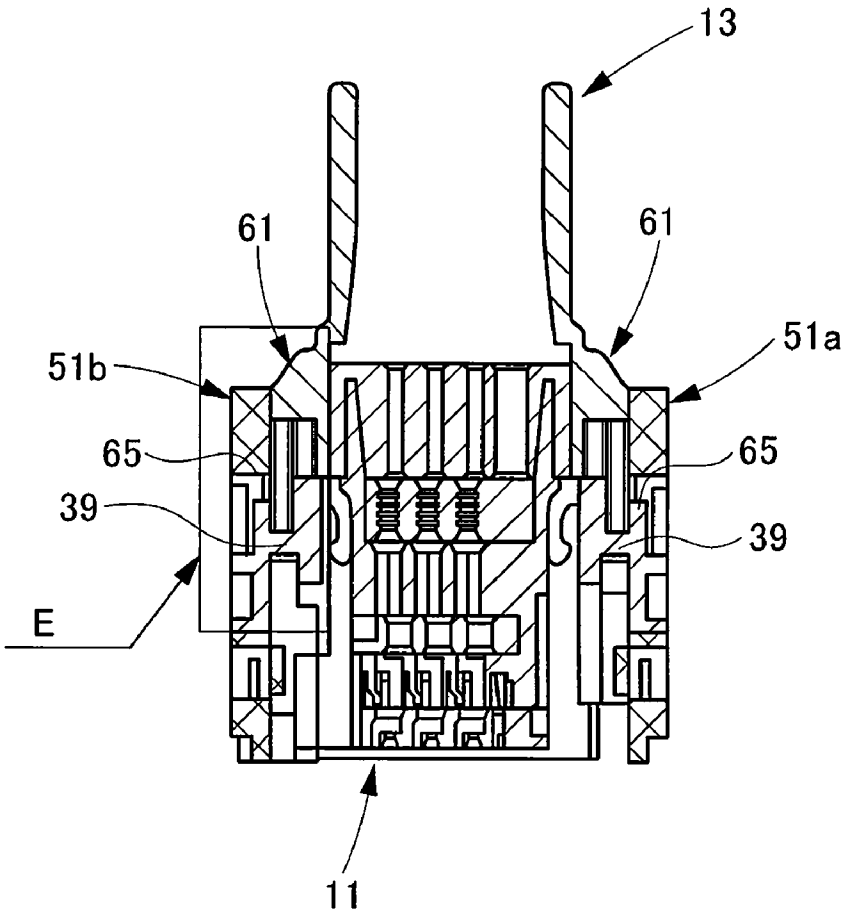
FIG. 11A is a cross-sectional view taken along the line D-D of FIG. 10.
Figure 12:
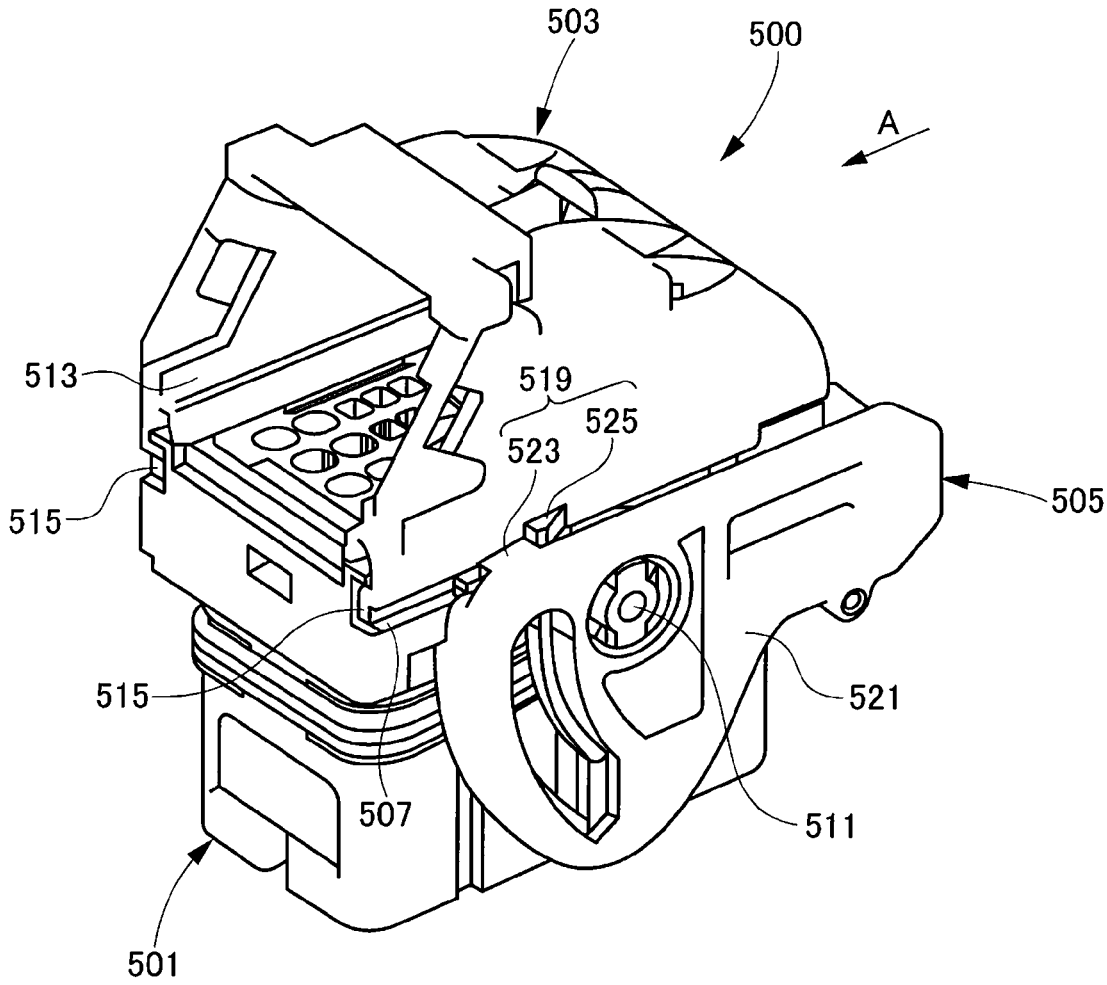
FIG. 12 is a perspective view of a conventional lever-type connector.
Figure 13:
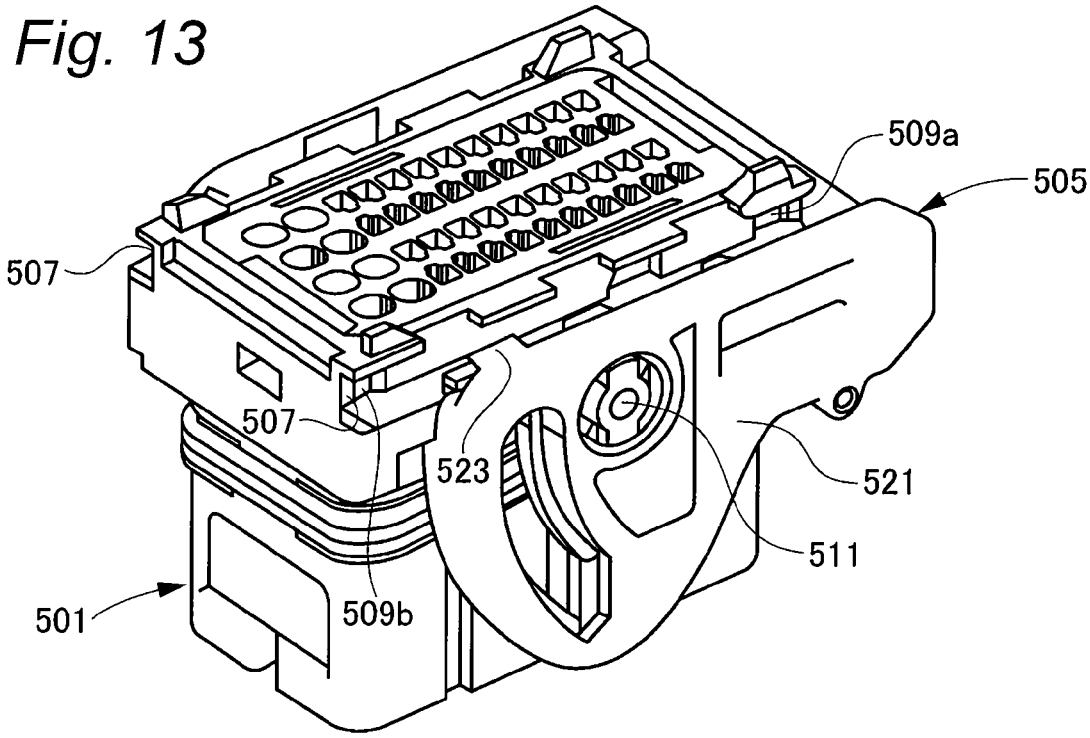
FIG. 13 is a perspective view of the lever-type connector of FIG. 12 from which a wire cover is removed.
Figure 14:
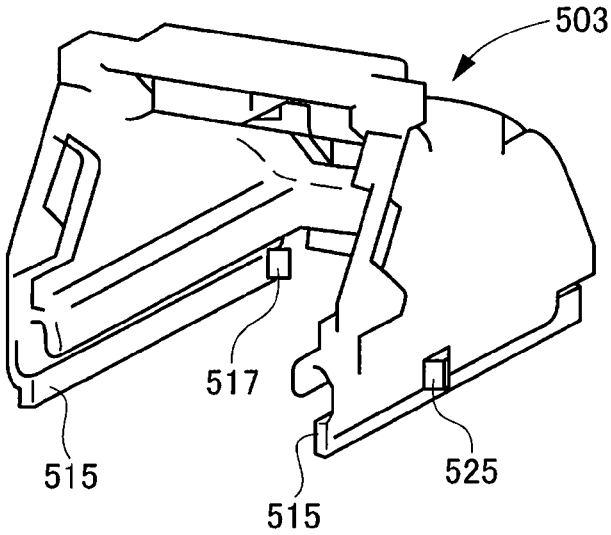
FIG. 14 is a perspective view of the wire cover shown in FIG. 12.
Figure 15:
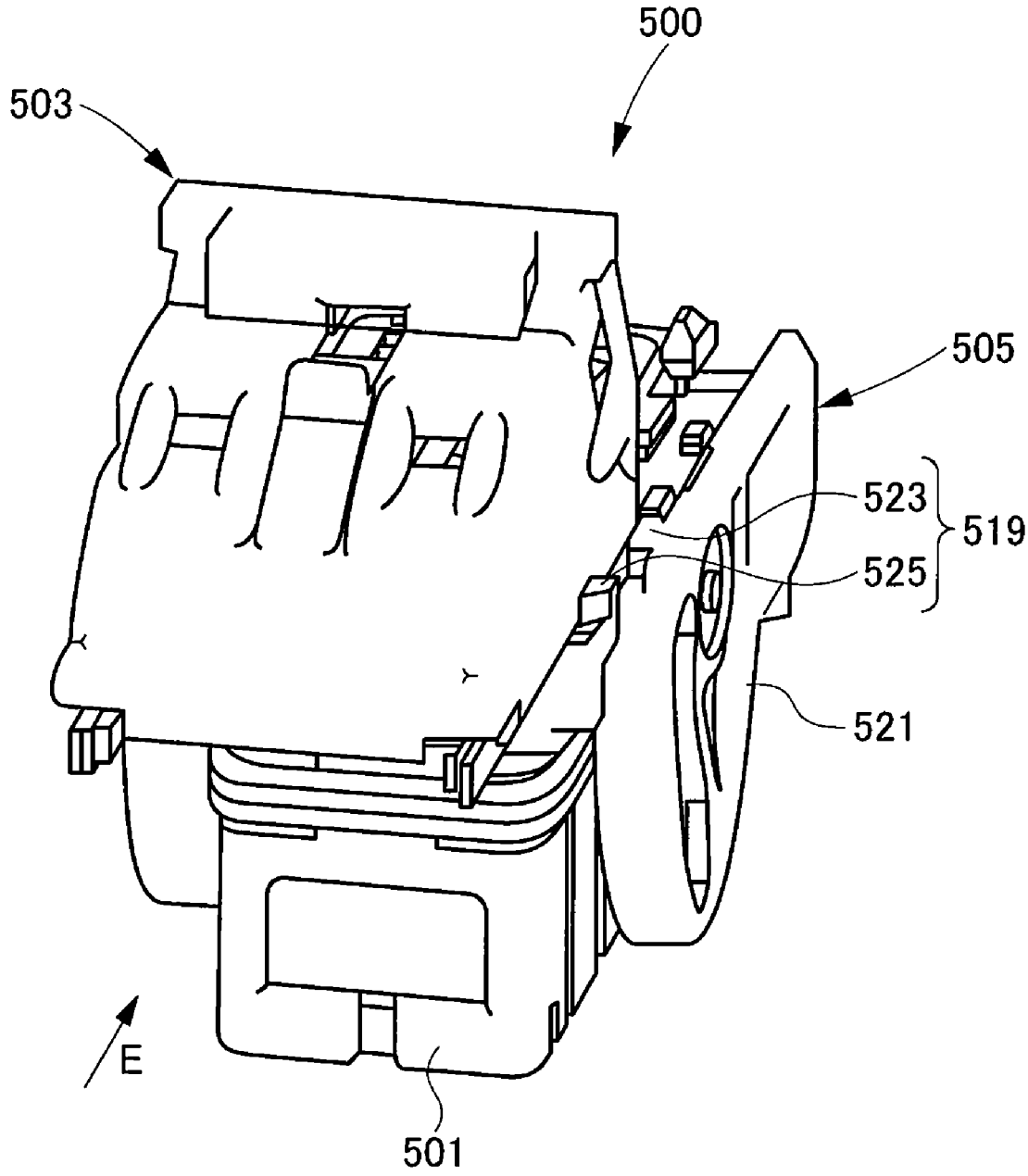
FIG. 15 is a perspective view of the conventional lever-type connector showing a condition in which the wire cover is in the process of being attached in a reverse direction.

FIG. 11A is a cross-sectional view taken along the line D-D of FIG. 10, and FIG. 11B is an enlarged view of a portion E of FIG. 11A.

When the arm portions 55 slide respectively onto the detection projections 61, the parallel plates 51*a* and 51*b* are separated respectively from the opposite side portions 11*a* and 11*b* of the connector housing 11, and are deformed and displaced respectively toward the distal ends of the shafts 39 by abutments of the detection projections 61, as shown in FIG. 11A. When the parallel plates 51*a* and 51*b* are thus displaced respectively toward the distal ends of the shafts 39, the keys 65 which are originally designed to project respectively into the key receiving recesses 69 so as to enable the rotation of the parallel plates 51*a* and 51*b* are disposed in the key grooves 67, respectively, as shown in FIG. 11B. The keys 65 formed respectively at the distal ends of the shafts 39 are fitted respectively in the key grooves 67, thereby preventing the rotation of the parallel plates 51*a* and 51*b* relative to the shafts 39.

Thus, in the lever-type connector 100, when the lever 15 is attached in the wrong direction, the arms 55 of the lever 15 slide respectively onto the detection projections 61 formed on the wire cover 13 at the time of attaching the lever 15, and the rotation of the lever 15 is prevented by the rotation prevention means 63.

The rotation prevention means 63 are provided at the pair of shafts 39 and the pair of parallel plates 51*a* and 51*b*. The rotation prevention means 63 are thus provided at the opposite sides of the connector housing 11, respectively, and with this construction the strength for preventing the rotation of the wrongly-attached lever 15 is increased. Therefore, the wrongly-attached lever 15 is more positively prevented from being pivotally moved.

Therefore, in the above lever-type connector 100, when the lever is wrongly attached in the reverse direction, the parallel plates 51*a* and 51*b* of the lever 15 slide respectively onto the detection projections 61, and the pivotal movement of the lever 15 is prevented by the rotation prevention means 63 provided at the shafts 39 and the reception holes 57, and the pivotal movement of the wrongly-attached lever 15 can be positively prevented.

And, when the lever 15 is attached in the reverse direction, the lever 15 can not be provisionally retained, and therefore an early judgment can be made, and it does not take a long time for the lever 15 to be reset. And besides, the lever 15 can be reset before it is provisionally retained, and therefore the shafts 39 and the lever 15 will not be damaged.

In the above embodiment, the wire cover 13 is attached to the connector housing 11 earlier than the lever 15. In the lever-type connector 100, however, even when the lever 15 is earlier attached, the wrong attachment of the lever 15 can be detected. Namely, for example, when the lever 15 is wrongly attached in the direction shown in FIG. 10, each key 65 abuts against the left end of the key receiving recess 69, and the lever 15 is prevented from being pivotally moved in a direction reverse to a direction as indicated as arrow g in the drawing. The positional relation between each key 65 and the corresponding key groove 67 and the positional relation between each arm 55 and the corresponding detection projection 61 are so determined that when the wire cover 13 is earlier attached, each arm 55 slides onto the detection projection 61 in this condition.

Therefore, when the wire cover 13 is later attached to the connector housing 11 to which the lever 15 has been wrongly attached, the vertical portions 61*a* (see FIG. 3) of the detection projections 61 formed at the wire cover 13 abut respectively against the arm portions 55 of the lever 15, which is now unable to pivotally move, from the upper side. The wire cover 13 abutting against the arm portions 55 is prevented from approaching the connector housing 11 by an amount corresponding to the amount of sliding of the arm portion 55 onto the detection projection 61. Namely, the arms 55 have already been disposed there, the wire cover 13 can not reach the intended attachment position. The retaining projections 29 of the wire cover 13 can not be retained respectively on the wire cover retaining portions 27, and the attachment of the wire cover 13 is prevented. As a result, the wrong attachment of the lever 15 is detected.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2009-219563 filed Sep. 24, 2009 including specification, drawings and claims is incorporated herein by reference in it is entirety.

What is claimed is:

1. A lever-type connector, comprising:

a housing formed with an opening in front face thereof in a first direction in which a mating connector is fitted, and having a rear face from which a wire is led out in a second direction orthogonal to the first direction;

a wire cover attached to the housing and having a lead-out port of the wire opening in the second direction;

a pair of shafts extended from both sides of the housing in a third direction orthogonal to both of the first direction and the second direction;

a lever attached to the housing and having a pair of parallel plates and a grip portion connecting the parallel plates, each of the parallel plates formed with a hole in which the shaft is inserted;

a projection provided on the wire cover and configured to abut one of the parallel plates in a state where the lever is attached to the housing so that the grip portion is disposed at a side of the lead-out port; and a rotation preventing part provided at one of the shafts and the hole of the one of the parallel plates and configured to prevent a rotation of the lever in a state where the one of the parallel plates is deformed by the abutment of the projection.

2. The lever-type connector as set forth in claim 1, wherein the rotation preventing part includes:

a key projected from the shaft in a radius direction of the shaft;

a key groove formed on an inside face opposing the housing so as to cutout an inner face of the hole in the radius direction; and a recess formed on an outside face opposite to the inside face with the hole and configured to allow the rotation of the one of the parallel plates with respect to the key.

3. The lever-type connector as set forth in claim 1, further comprising:

the rotation preventing part is provided at the pair of shafts and the holes of the pair of the parallel plates.

4. The lever-type connector as set forth in claim 2, further comprising:

the rotation preventing part is provided at the pair of shafts and the holes of the pair of the parallel plates.

5. The lever-type connector as set forth in claim 1, wherein the wire cover is configured to be attached to the housing so that the lead-out port opens in one of frontward of the second direction and rearward of the second direction.

* * * * *